US005255614A

United States Patent [19]

Voss-Schrader et al.

[11] Patent Number: 5,255,614

[45] Date of Patent: Oct. 26, 1993

[54] KNOCK DOWN DISPOSABLE PALLET

[75] Inventors: Bertil Voss-Schrader, Korshamnsviken, S-139 00 Värmdö; Fred G. V. Atterby, Lidingö, both of Sweden

[73] Assignee: Bertil Voss-Schrader, Varmdo, Sweden

[21] Appl. No.: 214,819

[22] Filed: Jul. 1, 1988

Related U.S. Application Data

[63] Continuation of Ser. No. 819,478, Jan. 16, 1986, which is a continuation of Ser. No. 552,129, Oct. 28, 1983, abandoned.

[30] Foreign Application Priority Data

Mar. 16, 1982 [SE] Sweden ..... 8201648-6

[51] Int. Cl.[5] ..... B65D 19/26

[52] U.S. Cl. ..... 108/56.1; 108/51.1; 108/51.3

[58] Field of Search ..... 108/51.1, 51.3, 56.1, 108/52.1, 56.3, 901, 902; 206/600

[56] References Cited

U.S. PATENT DOCUMENTS

| | | | |
|---|---|---|---|
| 699,475 | 5/1902 | Bechtel . | |
| 2,296,782 | 9/1942 | Fischer et al. . | |
| 2,444,183 | 6/1948 | Cahners . | |
| 2,446,914 | 8/1948 | Fallert et al. . | |
| 2,479,728 | 8/1949 | Darling . | |
| 2,576,715 | 11/1951 | Farrell . | |
| 2,609,136 | 9/1952 | Sider . | |
| 2,728,545 | 12/1955 | Hermitage . | |
| 2,783,011 | 2/1957 | Alexander . | |
| 2,798,685 | 7/1957 | Mooney . | |
| 2,930,481 | 3/1960 | Bebie | 108/51.1 X |
| 3,000,603 | 9/1961 | Hemann . | |
| 3,059,887 | 10/1962 | Ward, Jr. . | |
| 3,131,656 | 5/1964 | Houle | 108/51.3 |
| 3,165,078 | 1/1965 | White | 108/56.1 X |
| 3,256,839 | 6/1966 | Peterson et al. | 108/56.1 |
| 3,434,435 | 3/1969 | Achermann et al. . | |

(List continued on next page.)

FOREIGN PATENT DOCUMENTS

| | | | |
|---|---|---|---|
| 295405 | 1/1972 | Austria . | |
| 575461 | 5/1957 | Canada . | |
| 43253 | 1/1982 | European Pat. Off. . | |
| 0067087 | 12/1982 | European Pat. Off. . | |
| 2111135 | 9/1972 | Fed. Rep. of Germany . | |
| 2152859 | 4/1973 | Fed. Rep. of Germany | 108/51.1 |
| 2733213 | 2/1979 | Fed. Rep. of Germany | 108/52.1 |
| 612848 | 11/1926 | France . | |
| 1418284 | 10/1965 | France | 206/600 |
| 2236741 | 2/1975 | France | 108/51.1 |
| 143568 | 12/1953 | Sweden . | |
| 967876 | 10/1982 | U.S.S.R. | 108/51.1 |
| 709051 | 5/1954 | United Kingdom . | |
| 1163135 | 9/1969 | United Kingdom . | |
| 1580023 | 11/1980 | United Kingdom . | |

OTHER PUBLICATIONS

WO 81/02283—International Publication of PCT/US80/01768 Parent Case U.S. Ser. No. 119,827, filed Feb. 8, 1980. Intl. Pub. Date: Aug. 20, 1981—Inventor: L. E. Tisdale.

*Primary Examiner*—Peter A. Aschenbrenner
*Attorney, Agent, or Firm*—Young & Thompson

[57] ABSTRACT

Pallet, especially a disposable pallet, consisting of two outer base members (1) and preferably at least one intermediary base member (1), which base members suitably are identical and consist preferably of wood or a similar material, the height of which suitably corresponds to the conventional pallet height and the thickness of which suitably is within the range 20–100 mms, especially about 25–35 mms, having two recesses (2) intended for the introduction of the forks of a forklift truck and a number of holes (3) distributed along the length of the base members and perpendicularly thereto and at a minor distance from the upper surface of the base members or touching the same and that the base members (1) are united with each other by tubes (4) running through the holes (3) to the formation of the pallet.

8 Claims, 1 Drawing Sheet

U.S. PATENT DOCUMENTS

| | | | |
|---|---|---|---|
| 3,463,371 | 9/1969 | Gifford . | |
| 3,469,542 | 9/1969 | Ahlenius | 108/56.1 |
| 3,601,067 | 8/1971 | Olsen . | |
| 3,650,225 | 3/1972 | Ball | 108/51.1 |
| 3,654,877 | 4/1972 | Barrett | 108/56.1 |
| 3,659,534 | 5/1972 | Childs . | |
| 3,675,345 | 7/1972 | Abrams . | |
| 3,683,822 | 8/1972 | Roberts et al. . | |
| 3,881,429 | 5/1975 | Seymore . | |
| 3,911,834 | 10/1975 | Quaintance . | |
| 3,952,672 | 4/1976 | Gordon et al. . | |
| 4,140,295 | 2/1979 | Daley . | |
| 4,467,728 | 8/1984 | Horne . | |
| 4,494,897 | 1/1985 | Rogers . | |
| 4,563,377 | 1/1986 | Melli . | |

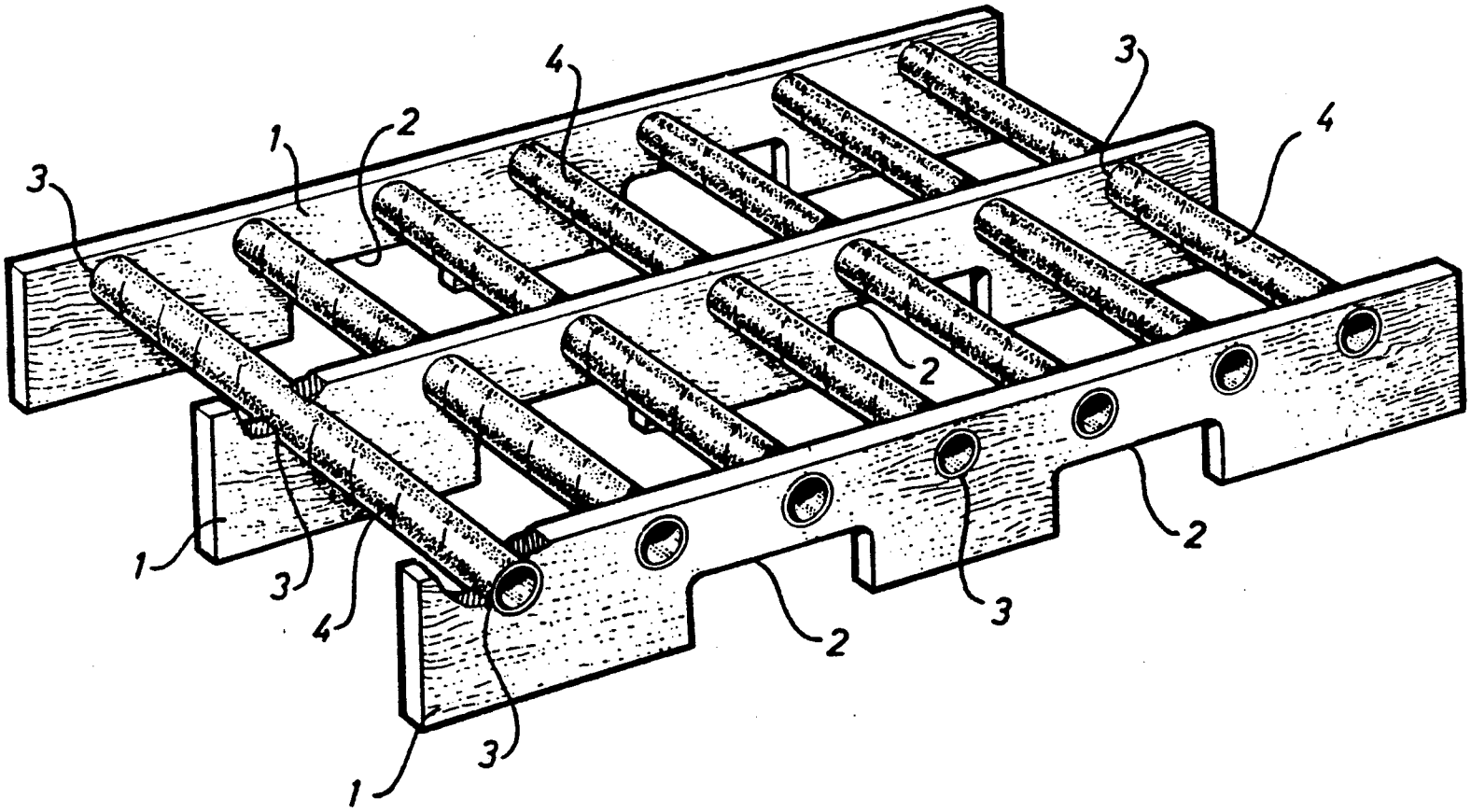
4
3
2
3
2
4
2
1
3
3
4
1
1
3

KNOCK DOWN DISPOSABLE PALLET

This application is a continuation of application Ser. No. 06/819,478, filed Jan. 16, 1986 now abandoned which is a continuation of 06/552,129, filed Oct. 28, 1983, now abandoned.

The present invention relates to a pallet, more particularly to a pallet which can be thrown away or disposed of after use.

Pallets of a standardized format are nowadays used extensively for transport and storage of all types of goods. Such pallets are usually manufactured from unplaned boards and blocks. Such pallets have the disadvantage of being heavy and difficult to handle and are also cost-demanding in manufacturing and handling, the latter especially due to the high weight of the pallets, usually 30–40 kgs. Wood has during the later years become more and more expensive and attempts have been made to construct pallets with a lower weight and accordingly lesser raw material requirements which thus will become cheaper to manufacture and also to use. It should be noted that the weight of the pallet per se is of importance since the freight costs are calculated on the total weight of the pallet load and the pallet. Further, there are handling and return freight costs. It has also been attempted to manufacture pallets from corrugated cardboard, metal plate and different types of foamed plastics with or without reinforcements. Such pallets have, however, not been a commercial success.

Accordingly, there is a great need for a pallet which combines especially the following properties: low costs, low weight, great flexibility as regards the use, non-bulky during storage since it can be stored in the form of separate parts which can easily be mounted together at the place of loading, and easily destructed, if desired, e.g. by burning to the formation of non-noxious gases. The present invention relates to such a pallet.

The above-mentioned previously known alternative pallets are mainly intended for goods of light or medium weight. An important property in pallets is, however, that they shall be possible to handle by forklifts from all four sides, i.e. a forklift truck should be able to lift the pallets from any side thereof, a forklift truck with long forks being able to lift several pallets at the same time. The said previously known alternative pallet constructions are, however, usually only forkable from two sides which has caused a considerable delimitation of the usability and an economic disadvantage. An important purpose with the present invention is to achieve a low-cost pallet which can be handled by forklifts from all four sides.

According to the present invention a pallet is achieved, especially a pallet which is so cheap so that it can be used only once and than disposed of, which is described below with reference to the enclosed drawing which shows a specific form of a pallet according to the invention viewed in perspective.

The attached drawing is a perspective view of one embodiment of the knock down disposable pallet of the present invention.

The specific preferred form of the pallet shown in the drawing consists of three base members 1 of which the two outer once form the outer edges of the pallet. The shown pallet has also an intermediary base member 1. The base members 1 have two symmetrically arranged recesses at such a distance from each other that corresponds the distance between the forks of a conventional standardized fork truck. The base members 1 are provided with a number of holes evenly distributed along the length of the base members and perpendicularly thereto and at a minor distance from the upper surface of the base members or touching the same. The base members 1 are united to each other with tubes 4 inserted through the holes 3. The outer diameter of the tubes is such that they can be relatively easy introduced through the holes 3 in the base members. A pallet according to the invention can thus in a simple manner be mounted with the use of two, three or several base members 1 and a suitable number of tubes introduced through the holes. Practical experiments have shown that the pallet according to the invention has a remarkable stability and there is no risk whatever that a tube will accidentally be removed or put out of its proper position in view of the friction between the base members and the tubes. The pallet according to the invention has also a certain diagonal flexibility which makes the pallet able to withstand shocks without bursting of the base members or other deterioration occurring.

It is preferred to manufacture the base members from wood, the wood fibres of course running essentially along the length of the base members, but also other materials can be used. Examples of such materials are plywood, board, etc. Also plastic materials can be used and also deep-drawn plate or cast aluminium.

The tubes 4 can be made of any suitable cheap material such as metal and plastics of different types but, for cost reasons, it is preferred to manufacture the tubes from paper. Such tubes are conventionally manufactured by winding of paper webs around a core. With the use of a water-resistant glue the finished pallet will be weather-resistant. Practical experiments have shown that a suitable outer diameter of the paper tubes is 45–60 mms with a material thickness of about 2–5 mms.

The height of the base members is about 160 mms and their thickness can be varied considerably, e.g. within the range 20–100 mms, especially about 25–35 mms. For conventional pallet sizes and a tube diameter of about 48 mms and a material thickness of 4 mms and a thickness of about 25 mms of the base members a pallet according to the invention will weigh about 6–8 kgs. This means, of course, that considerable decreases of the costs for handling and transportation of goods can be achieved.

The pallet according to the invention can, of course, be used more one time but practical calculations have shown that a pallet according to the invention can be prepared at a lower cost than the total cost for mortgage, freight, return freight and reparation and drying as commonly occurs for a conventional pallet. This means that a pallet according to the invention without economical considerations can be discarded after one use. The preferred material choice for a pallet according to the invention makes it easy to dispose of such as by burning without the formation of noxious gases.

It will be evident from the above that the tubes and the base members do not need attachment to each other specifically. In view of the multitude of tubes and the usually used three base members these parts will always be in a state of tension in relation to each other which causes the different parts to be effectively fixed to each other, especially when the pallet is under load. However, it is, of course, preferred that the adaptation of the tubes to the diameter of the holes in the base members is made as exactly as possible which also facilitates the putting-together of the pallet at the place of loading. One specifically suitable way to achieve this is to rub the inner surfaces of the holes after boring of the same with a rotating roughening tool such as a steel thread brush. With such a treatment a layer of free fibre ends will be formed in the holes which gives a slight friction for the tubes. Also, any dimension changes which wood materials are likely to undergo due to variation of the moisture content of the ambient air will thus be compensated for.

As mentioned above the base members and the tubes are kept separately which results in a considerable decrease of the required storage space in relation to conventional pallets. Assembling of the parts is suitably made with the use of a simple jig wherein the base members, two, three or more, are placed upon each other, whereafter the desired number of tubes are introduced into the holes. (For light loads some of the tubes can, of course, be omitted). The free ends of the tubes are fixed and grasping members of the jig will then move the uppermost base members along the tubes to the intended position thereon. Other devices for assembling the pallet according to the invention can, of course, be arranged as suitable in different cases.

We claim:

1. A knock down disposable pallet comprising two outer non-tubular base members (1) and at least one intermediate non-tubular base member (1), each of which base members are identical, have a height which corresponds to the conventional pallet height, a thickness in the range of 20 to 100 millimeters, have two mutually parallel outer surfaces through which extend a number of cylindrical holes (3) and through which extend recesses (2) intended for the introduction of the forks of a forklift truck, the holes (3) being distributed along the length of the base members and perpendicular thereto, the base members (1) being united with each other by tubes (4) running through the cylindrical holes (3), the dimension of the holes relative to the dimension of the tubes being such that the tubes and base members are united by friction between the tubes and the inner surfaces of the cylindrical holes, the holes (3) being located a minor distance below the upper surface of the base members, and the tubes in their entirety, also being a minor distance below the upper surface of the base members, to provide load bearing surfaces which do not form a part of the substantially flat load bearing surface formed by the upper surface of the base members.

2. A knock down disposable pallet according to claim 1 wherein there are at least seven of the holes (3) and there are at least four of the tubes (4) positioned within select of the holes (3).

3. A knock down disposable pallet according to claim 1 wherein the base members and the tubes comprise weather-resistant materials.

4. A knock down pallet according to claim 1 wherein the thickness of each base member is in the range of 25 to 35 millimeters.

5. A knock down disposable pallet according to claim 1 wherein the tubes (4) comprise a plurality of rolled layers of a paper web which layers are adherred together by a water-resistant glue.

6. A knock down disposable pallet according to claim 1 wherein the base members comprise wood.

7. A knock down disposable pallet according to clam 1 wherein the base members comprise a wood-like material.

8. A knock down disposable pallet comprising two outer nontubular base members (1) and at least one intermediate nontubular base member (1), each of which base members are identical, have a height which corresponds to the conventional pallet height, a thickness in the range of 20 to 100 millimeters, have two mutually parallel outer surfaces through which extend a number of cylindrical holes (3) having uninterrupted circumferences and through which extend recesses (2) intended for the introduction of the forks of a forklift truck, the holes (3) being distributed along the length of the base members and perpendicular thereto, the holes (3) being located a minor distance below the upper surface of the base members and tubes (4) running through holes (3) also being located in their entirety a minor distance below the upper surface of the base members, to provide load bearing surfaces which do not form a part of the substantially flat load bearing surface formed by the upper surfaces of the base members, and the base members (1) being united with each other by tubes (4) running through the cylindrical holes (3), the dimension of the holes relative to the dimension of the tubes being such that said tubes can be easily introduced through said holes in assembling the pallet, upon assembly of the pallet in its unloaded mode the tubes and base members are in a state of tension relative to each other to effectively fix said tubes to said base members, and that in its loaded mode the tubes and base members are united by friction alone between the tubes and the inner surfaces of the cylindrical holes.

* * * * *